US007143871B2

(12) United States Patent
Wesson et al.

(10) Patent No.: US 7,143,871 B2
(45) **Date of Patent: *Dec. 5, 2006**

(54) ELEVATOR ROLLER GUIDE AND RAIL ASSEMBLY

(75) Inventors: John P. Wesson, Vernon, CT (US); Neil R. Baldwin, Manchester, CT (US)

(73) Assignee: Otis Elevator Company, Farmington, CT (US)

( * ) Notice: Subject to any disclaimer, the term of this patent is extended or adjusted under 35 U.S.C. 154(b) by 206 days.

This patent is subject to a terminal disclaimer.

(21) Appl. No.: 10/735,201

(22) Filed: Dec. 12, 2003

(65) Prior Publication Data

US 2004/0124038 A1 Jul. 1, 2004

Related U.S. Application Data

(62) Division of application No. 09/648,016, filed on Aug. 25, 2000, now Pat. No. 6,945,364.

(51) Int. Cl.
*B66D 13/08* (2006.01)

(52) U.S. Cl. ..... 187/334; 187/313; 187/324

(58) Field of Classification Search ..... 187/316, 187/324, 334; 49/358, 360
See application file for complete search history.

(56) References Cited

U.S. PATENT DOCUMENTS

| | | | | |
|---|---|---|---|---|
| 1,881,014 | A | | 10/1932 | Ayers |
| 1,881,017 | A | | 10/1932 | Jacobson |
| 2,303,263 | A | | 11/1942 | Fisher |
| 2,493,162 | A | | 1/1950 | Olds |
| 2,611,920 | A | | 9/1952 | Borden |
| 3,426,480 | A | | 2/1969 | Dzamba |
| 3,855,732 | A | | 12/1974 | Sheaf |
| 4,016,920 | A | | 4/1977 | Shepard |
| 4,177,881 | A | | 12/1979 | Kappenhagen |
| 4,262,451 | A | | 4/1981 | Dallaire |
| 4,355,486 | A | | 10/1982 | Sherwood |
| 4,905,345 | A | | 3/1990 | Lunenschloss et al. |
| 5,036,621 | A | | 8/1991 | Iwasaki |
| 5,165,142 | A | | 11/1992 | Pilsbury |
| 5,594,316 | A | | 1/1997 | Hayashida |
| 5,655,626 | A | | 8/1997 | Spiess |
| 5,667,039 | A | | 9/1997 | Spiess |
| 5,701,973 | A | * | 12/1997 | Tracey ..... 187/316 |
| 5,711,112 | A | * | 1/1998 | Barten et al. ..... 49/118 |
| 5,852,897 | A | | 12/1998 | Sukale |
| 5,959,373 | A | * | 9/1999 | Cho ..... 310/12 |
| 6,543,581 | B1 | * | 4/2003 | Durand et al. ..... 187/316 |
| 6,581,332 | B1 | * | 6/2003 | Kim ..... 49/358 |

* cited by examiner

*Primary Examiner*—Kathy Matecki
*Assistant Examiner*—Evan H. Langdon
(74) *Attorney, Agent, or Firm*—Carlson, Gaskey & Olds

(57) ABSTRACT

An elevator door assembly includes a rail and at least one roller that rolls along the rail to move a door between opened and closed positions, for example. A resilient track is provided on the rail that facilitates more efficient roller movement and increases the longevity of the assembly. In one example, the resilient track includes several pieces of flexible material that are snapped in place onto the rail. In another example, the flexible track is supported on the rail using a spray coating technique.

21 Claims, 2 Drawing Sheets

ELEVATOR ROLLER GUIDE AND RAIL ASSEMBLY

This application is a divisional of U.S. patent application Ser. No. 09/648,016, which was filed on Aug. 25, 2000, now U.S. Pat. No. 6,945,364 issued Sep. 20, 2005.

BACKGROUND OF THE INVENTION

This invention generally relates to elevator door systems. More particularly, this invention relates to an assembly with a unique roller guide for guiding rollers along a rail for moving an elevator door.

Typical elevator door systems include a door frame supported by rollers that roll along a rail so that the door can be moved between opened and closed positions. The rollers typically are driven along the rail using mechanical links, cables, linear motors or other assemblies. In most instances, the rail is made of a metal material while the rollers include a metal or plastic wheel with a flexible material around the circumference of the wheel that rides along the rail. The flexible material is provided on the roller to dampen or reduce noise and vibration during door movement. Another purpose for providing a flexible material around the circumference of the roller is to provide traction control.

One difficulty associated with conventional roller and rail assemblies is that the rail surface is subject to wear and corrosion. Typical rails are made from steel or aluminum and require a surface treatment to resist wear and corrosion. Although various attempts have been made to coat rails, no surface protection method to date has proven completely satisfactory, in part, because of the unavoidable presence of abrasive debris in an elevator hoistway. Coatings are also undesireably expensive.

The challenge of designing a roller and rail system has become further complicated by the introduction of powered rollers for moving elevator doors. In these instances, the roller and rail interaction must not only support the door but also provide sufficient traction for moving the door. Competing design considerations come into play because the roller must maintain a reasonable contact footprint while, at the same time, having a small enough diameter to fit within the available space design constraints of a typical elevator system.

This invention addresses the needs for prolonging the life of the roller and rail system while enhancing available traction and increasing the longevity of the elevator door assembly. This invention avoids the shortcomings and drawbacks described above.

SUMMARY OF THE INVENTION

In general terms, this invention is an assembly for use in an elevator door system that includes a rail and at least one roller that is adapted to move along the rail. The rail includes at least one supporting surface along one side. A resilient track is at least partially received by the supporting surface on the rail. The roller then rolls along the track as the door is moved relative to the rail.

In one example, the track is a flexible insert that is snapped into place on the rail. The track can be removed and replaced over time as may be required.

In another example, the track is a sprayed on material that forms a resilient surface on the supporting surface of the rail.

In another example, the track is a flexible insert that includes several different pieces. Each of the pieces can be made from a different material, for example, to achieve different friction characteristics at different locations along the length of the rail. For example, higher friction is desired at the ends of the rail where the rollers accelerate and decelerate as the elevator door is moved from one extreme to another. A central portion of the track can include a smoother surface that provides quieter door operation.

The various features and advantages of this invention will become apparent from the following detailed description of the currently preferred embodiments. The drawings that accompany the detailed description can be briefly described as follows.

DETAILED DESCRIPTION OF THE PREFERRED EMBODIMENT

Figure 1:
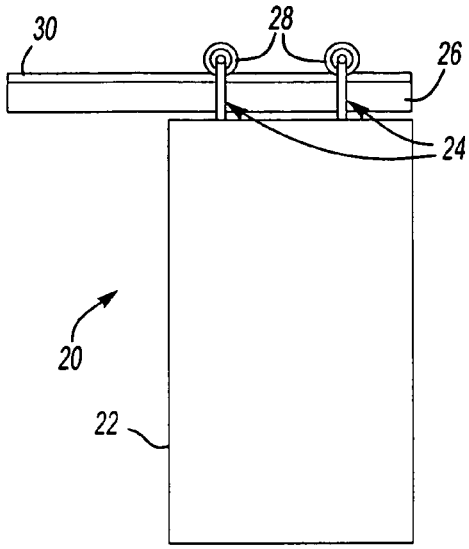
FIG. 1 diagrammatically illustrates an elevator door system incorporating an assembly designed according to this invention.

An elevator door assembly 20 includes a door frame 22 supported by a conventional support device 24. The door frame 22 is supported to move along a rail 26 through the movement of rollers 28 so that the door can be moved between opened and closed positions, for example.

Figure 2:
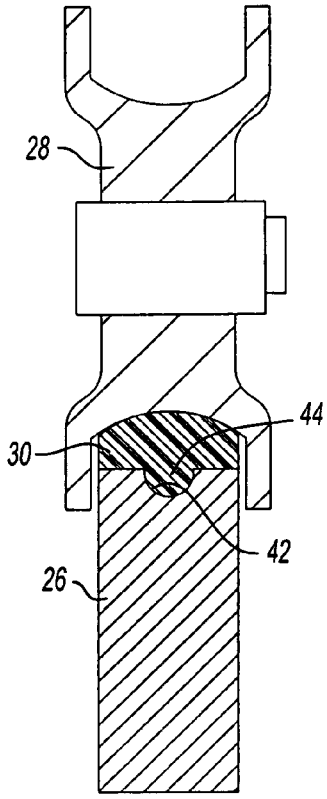
FIG. 2 is a cross-sectional view of a roller and rail.
Figure 3:
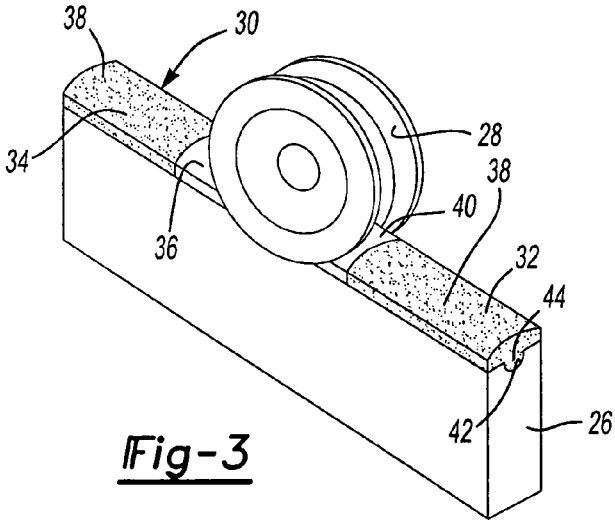
FIG. 3 diagrammatically illustrates a rail and roller assembly including a track designed according to this invention.

A resilient track 30 is included on one side of the rail 26. As best seen in FIGS. 2 and 3, one example of the track 30 is a resilient or flexible insert that is received on one side of the rail 26. In the illustrated example, the track 30 includes a first portion 32 and a second portion 34 at opposite ends of the track 30. A third portion 36 extends along a central portion of the rail 26. In the preferred embodiment, the track 30 extends along the entire length of the rail 26.

The first portion 32 and second portion 34 of the track 30 preferably include a traction surface 38, which can be realized in various forms. In one example, the surface of the track 30 is knurled or provided with a roughened surface for increased traction between the roller 28 and the track 30. The central portion or third portion 36 of the track 30 preferably includes a smooth surface 40 that allows for quiet roller operation as the roller rolls along the track 30. The two ends of the track preferably provide enhanced traction to facilitate better acceleration and deceleration at the ends of movement of the door. Since the velocity of the door is typically constant through a central portion of its motion, the smooth surface 40 preferably is provided along a central portion of the track 30. In practice, the third portion 36 typically is much longer than the end portions 32 and 34.

In one example, the first portion 32, the second portion 34 and the third portion 36 of the track 30 are separate pieces of flexible material. Each of the pieces can be individually and selectively replaced as may be needed over the life of the door assembly. Further, each of the track portions can be made from a different material to achieve different friction characteristics along different portions of the rail. Although three portions are illustrated and discussed, it is, of course, possible to use fewer or more portions as the needs of a particular situation may require. Separate pieces allow for easier maintenance or repair since only selected portions may be removed without disassembling the entire roller and rail assembly.

Figure 4:
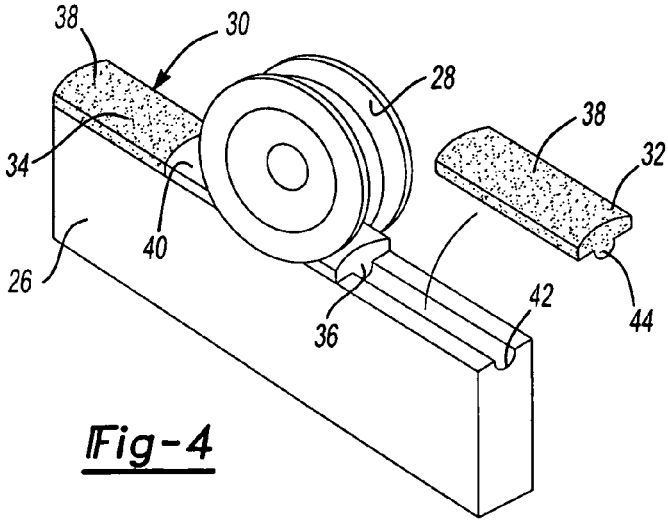
FIG. 4 illustrates a feature of the embodiment of FIG. 3.

In the embodiment illustrated in FIGS. 2 through 4, the track 30 is received onto the rail 26 using a snap-type arrangement. A groove 42 on the rail 26 receives a projection 44 on the track 30 so that the track 30 is snapped in place on the rail. Other connecting arrangements can be used, which may include clips or other fasteners.

In another example, the resilient track is applied using a spray coating technique. The track 30, in this example, can be applied and replenished over time as may be needed using a conventional spraying technique for applying a flexible material on a supporting surface of the rail 26.

The track 30 preferably is made from a flexible, resilient material. Example materials include polyurethane, polyester elastomers, fluoroelastomers, vulcanized synthetic rubber, other elastomers or other rubber materials. Incorporating a resilient track on the rail provides several advantages compared to prior roller and rail constructions. The track 30 eliminates the need for attempting expensive corrosion and wear resistant measures on the metallic surface of the rail. Moreover, the choice of materials for the rail 26 are expanded and can include softer, more easily extruded materials than was previously possible.

Another advantage to the inventive arrangement is that the roller design is greatly simplified. There is no longer a need to accommodate a flexible material around the exterior of the roller. Moreover, the choice of materials usable for the roller is expanded to include hardenable alloys, stainless steels, chromium, nickel, ceramics, other metals or glasses. Still further, the design of the roller itself is greatly simplified, and can become a simple ring or spool-shaped roller. A more simplified roller configuration allows for more versatility in applying coatings to the roller that will enhance wear resistance and corrosion resistance.

Figure 5:
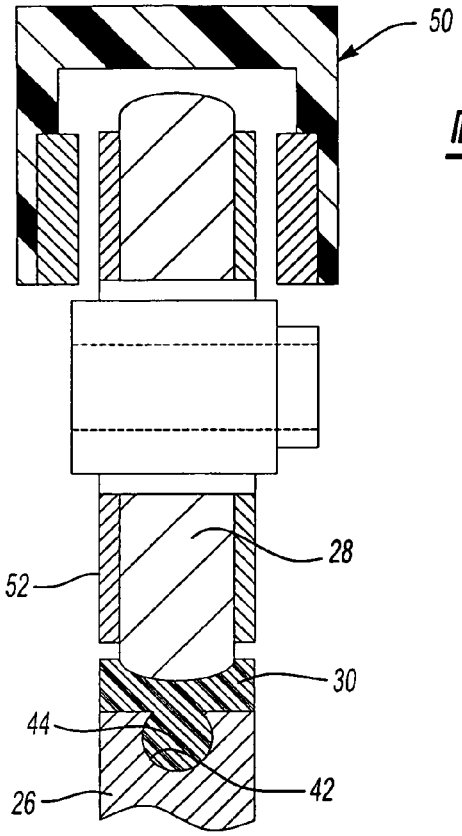
FIG. 5 illustrates an assembly designed according to this invention including a motorized roller drive.
Figure 6:
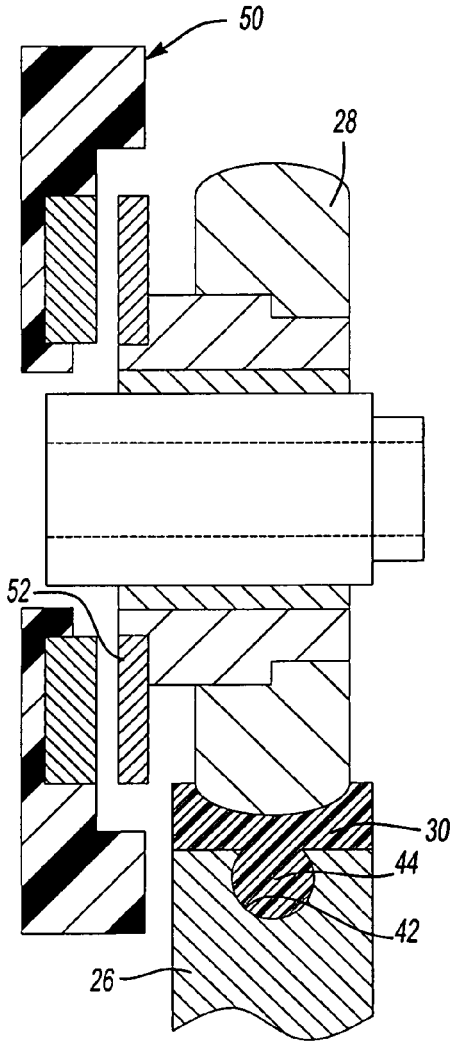
FIG. 6 shows an alternative motorized drive design.

Another advantage to using the inventive system is that a roller drive mechanism can be incorporated into the rollers. For example, in FIGS. 5 and 6, a motor assembly 50 is supported to move with the roller along the rail 26. In one example, the roller 28 includes a plurality of pole pieces 52 that are made from a magnetic material. The motor assembly 50 includes a magnetic motor arrangement that, when energized in a conventional fashion, causes the roller 28 to rotate and move along the rail 26. A variety of motor configurations can be used, depending on the needs of a particular circumstance. The roller 28 could be, for example, made of a ferrite material to interact with an appropriately designed electric motor assembly 50. Alternative constructions include pancake style motor assemblies with appropriately geared roller rings so that the roller 28 is driven along the rail 26 as desired.

The foregoing description is exemplary rather than limiting in nature. Variations or modifications to the disclosed examples of the inventive arrangement may become apparent to those skilled in the art. Such changes, however, do not necessarily depart from the scope or spirit of this invention. The scope of legal protection given to this invention can only be determined by studying the following claims.

The invention claimed is:

1. An elevator door assembly, comprising:

a door frame;

a door frame support member;

at least one roller associated with the support member;

a motor assembly associated with the roller for movement with the roller, the roller including a plurality of magnetic portions that cooperate with the motor assembly to cause selective movement of the roller;

a rail including at least one supporting surface along one side of the rail; and a resilient material track at least partially received by the supporting surface on the rail, the roller being able to roll along the track so that the door frame moves relative to the rail, the track comprises a plurality of independent portions that are selectively independently removable from the rail.

2. The assembly of claim 1, wherein the track has a first surface near the ends of the track and a second, surface which is different than the first surface, on a central portion of the track.

3. The assembly of claim 2, wherein the central portion surface is smooth.

4. The assembly of claim 1, wherein the resilient track material comprises at least one of polyurethane, a polyester elastomer, a flouroelastomer or vulcanized rubber.

5. The assembly of claim 1, wherein the resilient material track comprises a layer of a material that is sprayed onto the rail.

6. The assembly of claim 1, wherein the roller comprises a ferrous material.

7. The assembly of claim 1, wherein the roller comprises at least one of an alloy, stainless steel, chromium, nickel, ceramic or a glass material.

8. An elevator door assembly, comprising:

a rail including at least one supporting surface along at least one side of the rail;

a resilient material track at least partially received by the supporting surface on the rail, the resilient material having a first surface characteristic near at least one end of the track and a second surface characteristic that is different than the first surface characteristic on another portion of the track;

at least one roller that is adapted to roll along the track; and a motor assembly associated with the roller for movement with the roller, the roller including a magnetic portion that cooperates with the motor assembly to cause selected movement of the roller.

9. The assembly of claim 8, wherein the surface characteristics of the track comprise friction characteristics and wherein the first characteristic provides greater friction between the track and the roller than the second characteristic.

10. The assembly of claim 8, wherein the first surface characteristic comprises a rough surface and the second surface characteristic comprises a surface that is smoother than the rough surface.

11. The assembly of claim 8, wherein the track comprises multiple pieces, a first piece of one material having the first characteristic and a second piece of a second material.

12. The assembly of claim 8, wherein the resilient track material comprises at least one of polyurethane, a polyester elastomer, a flouroelastomer or vulcanized rubber.

13. The assembly of claim 8, wherein the resilient material track comprises a layer of a material that is sprayed onto the rail.

14. The assembly of claim 8, wherein the roller comprises at least one of an alloy, stainless steel, chromium, nickel, ceramic or a glass material.

15. The assembly of claim 8, wherein the track comprises a plurality of independent portions that are selectively independently removable from the rail.

16. The assembly of claim 8, wherein the first surface characteristic is near each end of the track.

17. The assembly of claim 8, wherein the magnetic portion is on an exterior of the roller.

18. The assembly of claim 8, wherein the motor assembly is outside of the roller.

19. The assembly of claim 1, wherein the plurality of magnetic portions are on an exterior of the roller.

20. The assembly of claim 1, wherein the motor assembly is outside of the roller.

21. An elevator door assembly, comprising:

a door frame;

a door frame support member;

at least one roller associated with the support member;

a motor assembly associated with the roller for movement with the roller, the roller including a plurality of magnetic portions that cooperate with the motor assembly to cause selective movement of the roller;

a rail including at least one supporting surface along one side of the rail; and a resilient material track at least partially received by the supporting surface on the rail, the roller being able to roll along the track so that the door frame moves relative to the rail, the track has a first surface near the ends of the track and a second surface, which is different than the first surface, on a central portion of the track.

* * * * *